US009696678B2

(12) United States Patent
Koyama

(10) Patent No.: US 9,696,678 B2
(45) Date of Patent: Jul. 4, 2017

(54) SHEET FEEDING APPARATUS AND IMAGE FORMING APPARATUS

(71) Applicant: CANON KABUSHIKI KAISHA, Tokyo (JP)

(72) Inventor: Fuyuko Koyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/670,860

(22) Filed: Mar. 27, 2015

(65) Prior Publication Data

US 2015/0286181 A1 Oct. 8, 2015

(30) Foreign Application Priority Data

Apr. 3, 2014 (JP) ..... 2014-076747

(51) Int. Cl.
*B65H 9/04* (2006.01)
*G03G 15/00* (2006.01)
(Continued)

(52) U.S. Cl.
CPC ..... *G03G 15/6555* (2013.01); *B65H 3/0607* (2013.01); *B65H 3/5223* (2013.01); *B65H 3/66* (2013.01); *B65H 5/062* (2013.01); *B65H 7/20* (2013.01); *B65H 9/004* (2013.01); *B65H 9/06* (2013.01); *G03G 15/6511* (2013.01); *G03G 15/6558* (2013.01); *B65H 2402/31* (2013.01); *B65H 2403/512* (2013.01);
(Continued)

(58) Field of Classification Search
CPC ..... G03G 15/6511; G03G 15/6558; G03G 15/6561; G03G 15/6564; G03G 15/6567; G03G 15/6555; G03G 2215/00396; G03G 2215/004; G03G 2215/00565; B65H 3/5223; B65H 9/004; B65H 9/04; B65H 2301/512125; B65H 2403/732; B65H 2404/722
See application file for complete search history.

(56) References Cited

U.S. PATENT DOCUMENTS 4,925,062 A * 5/1990 Tsukamoto ..... B65H 3/5284 271/114
5,057,874 A * 10/1991 Miyazaki ..... G03G 15/6579 399/396
(Continued)

FOREIGN PATENT DOCUMENTS

JP 63-147739 A 6/1988
JP 03-122675 A 5/1991
(Continued)

*Primary Examiner* — Justin Olamit
(74) *Attorney, Agent, or Firm* — Fitzpatrick, Cella, Harper & Scinto

(57) ABSTRACT

The sheet feeding apparatus of the invention includes a sheet stacking portion, a rotating body, a contact member, a conveyance guide, a driving source, a shutter member and a torque limiter. The torque limiter is disposed between the rotating body and the driving source, transmits a driving force of the driving source to the rotating body in a state that a load in the sheet feeding direction of less than a predetermined torque is applied to the rotating body, and not transmit the driving force of the driving source to the rotating body in a state that the load in the sheet feeding direction of more than the predetermined torque is applied to the rotating body.

12 Claims, 12 Drawing Sheets

(51) Int. Cl.

| | |
|---|---|
| ***B65H 3/52*** | (2006.01) |
| ***B65H 9/00*** | (2006.01) |
| ***B65H 3/06*** | (2006.01) |
| ***B65H 3/66*** | (2006.01) |
| ***B65H 5/06*** | (2006.01) |
| ***B65H 7/20*** | (2006.01) |
| ***B65H 9/06*** | (2006.01) |

(52) U.S. Cl.
CPC .. *B65H 2403/732* (2013.01); *B65H 2404/722* (2013.01); *B65H 2511/51* (2013.01); *B65H 2513/50* (2013.01); *G03G 2215/004* (2013.01); *G03G 2221/1657* (2013.01)

(56) References Cited

U.S. PATENT DOCUMENTS 5,244,191 A * 9/1993 Kanekura ..... B65H 1/24 271/10.11
5,760,811 A * 6/1998 Seto ..... H04N 1/40037 347/131
6,805,509 B2 * 10/2004 Ahn ..... G03G 15/6502 271/227
7,308,227 B2 * 12/2007 Ahn ..... G03G 15/6564 399/388
7,593,683 B2 * 9/2009 Kim ..... G03G 15/6561 271/258.01
8,498,566 B2 * 7/2013 Shoji ..... G03G 15/6558 399/162
8,511,669 B2 8/2013 Koyama
8,672,315 B2 * 3/2014 Goto ..... B65H 5/06 271/9.01
8,781,388 B2 * 7/2014 Yamaguchi ..... B65H 3/0607 271/121
2015/0054213 A1 * 2/2015 Miyake ..... B65H 3/34 271/121

FOREIGN PATENT DOCUMENTS

JP 07-267434 A 10/1995
JP 11-314806 A 11/1999

* cited by examiner

SHEET FEEDING APPARATUS AND IMAGE FORMING APPARATUS

BACKGROUND OF THE INVENTION

Field of the Invention

The present invention relates to a sheet feeding apparatus and an image forming apparatus.

Description of the Related Art

A conventional electro-photographic image forming apparatus such as a printer and a copier includes a sheet feeding portion feeding a sheet stacked in a sheet stacking portion and a sheet conveying portion conveying the sheet fed from the sheet feeding portion to an image forming portion. Here in the image forming apparatus, it is essential to accurately match a toner image formed in the image forming portion with a front end of the sheet conveyed from the sheet feeding portion at a transfer portion.

However, there is a case when a sheet feed starting position shifts in the sheet feeding apparatus due to a slip of the sheet, a shift of a position of the sheet stacked on the sheet stacking portion, and a double feed caused by a preceding sheet. In such a case, the feed of the sheet varies and it becomes hard to accurately match the toner image with the front end of the sheet at the transfer portion.

Still further, some conventional image forming apparatuses include a sensor detecting a front end of a fed sheet. The image forming apparatus forms a toner image on a photosensitive drum based on timing when the sensor detects a front end position of the fed sheet, primarily transfers the toner image thus formed to an intermediate transfer body and then secondarily transfers the toner image to the sheet at a secondary transfer portion. In such image forming apparatus, there is a case when a moving distance of the toner image from the photosensitive drum to the secondary transfer portion is longer than a sheet conveying distance from the front end position of the sheet stacked on the sheet stacking portion to the secondary transfer portion. In this case, the sheet arrives at the secondary transfer portion before the toner image arrives at the secondary transfer portion if the toner image is started to be formed on the photosensitive drum after detecting the front end position of the sheet fed from the sheet feeding apparatus by the sensor.

To that end, the conventional image forming apparatus is provided with a registration portion at downstream of the sheet feeding apparatus to let the front end of the sheet temporarily stand by at the registration portion and to convey the sheet again by matching with a timing when the toner image arrives at the secondary transfer portion. As disclosed in Japanese Patent Laid-open No. Sho. 63-147739, such registration portion is provided with a shutter member to temporarily stop a sheet passing through a sheet conveying path by the shutter member. The image forming apparatus provided with such registration portion includes a torque control mechanism between a driving shaft of a conveying roller disposed upstream of the shutter member and the conveying roller. Then, the registration portion is configured such that while controlling the front end of the sheet by the shutter member, the conveying roller temporarily stops its rotation by idly rotating the driving shaft by an action of the torque control mechanism to let the sheet stand by temporarily.

While the conventional image forming apparatus provided with such registration portion stops the conveying roller by the torque control mechanism during when the sheet is stopped by the shutter member, a feed roller disposed upstream of the conveying roller continuously feeds a sheet. Due to that, when the sheet temporarily stands by, a loop of the sheet is formed between the conveying roller and the feed roller. Here, in the configuration in which the loop is formed between the conveying roller and the feed roller, it is necessary to assure an enough loop forming space in which the loop of the sheet can be formed between the conveying roller and the feed roller.

By the way, because image forming apparatuses are required to be downsized lately, the distance between the feed roller and the conveying roller is shortened. If the distance between the feed roller and the conveying roller is shortened, the loop forming space is narrowed. If a loop is to be formed in such narrow loop forming space, a height of the loop with respect to a sheet feeding direction increases, destabilizing the feed of sheets such that a thin sheet whose rigidity is low causes buckling and a thick sheet whose rigidity is high increases a feeding load.

SUMMARY OF THE INVENTION

A sheet feeding apparatus of the present invention includes a sheet stacking portion on which a sheet is stacked, a rotating body contacting with an uppermost sheet of sheets stacked on the sheet stacking portion and feeding the uppermost sheet, a contact member in contact with the rotating body, a conveyance guide forming a sheet conveying path through which the sheet fed by the rotating body passes, a driving source capable of driving the rotating body, a shutter member movable between a first position where the shutter member abuts against a downstream end portion of the sheet fed by the rotating body and stops the sheet and a second position where the sheet passes the shutter member, and a torque limiter provided between the rotating body and the driving source, transmitting a driving force of the driving source to the rotating body in a state that a load in the sheet feeding direction of less than a predetermined torque is applied to the rotating body, and not transmitting the driving force of the driving source to the rotating body in a state that the sheet is stopped by the shutter member and the load in the sheet feeding direction of more than the predetermined torque is applied to the rotating body.

Further features of the present invention will become apparent from the following description of exemplary embodiments with reference to the attached drawings.

DESCRIPTION OF THE EMBODIMENTS

Figure 1:
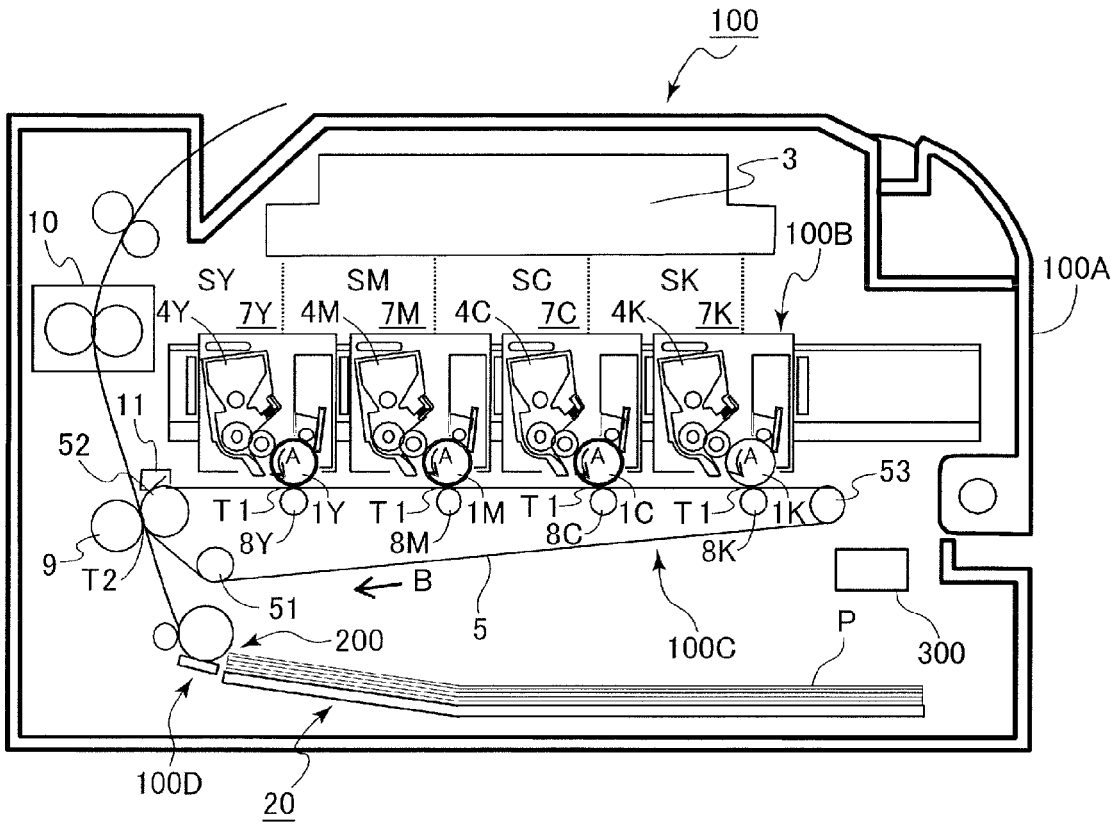
FIG. 1 is a schematic diagram of an entire full-color laser printer, i.e., an exemplary image forming apparatus, including a sheet feeding apparatus of a first embodiment of the present invention.

Embodiments of the present invention will be described in detail below with reference to the drawings. FIG. 1 is a schematic diagram of an entire full-color laser printer 100, i.e., an exemplary image forming apparatus, including a sheet feeding apparatus of a first embodiment of the present invention.

In FIG. 1, the full-color laser printer 100 includes a full-color laser printer body (referred to a 'printer body' herein after) 100A. It is noted that the full-color laser printer 100 is a printer adopting an intermediate transfer system and capable of forming a full-color image on a sheet such as a recording sheet, a plastic sheet, a cloth or the like in accordance to image information. The image information is inputted from an image reader not shown and connected to the printer body 100A or from a host apparatus such as a personal computer. The printer body 100A, i.e., the apparatus body, includes an image forming portion 100B forming an image on a sheet P, a sheet feeding apparatus 100D feeding a sheet, and others.

Figure 2:
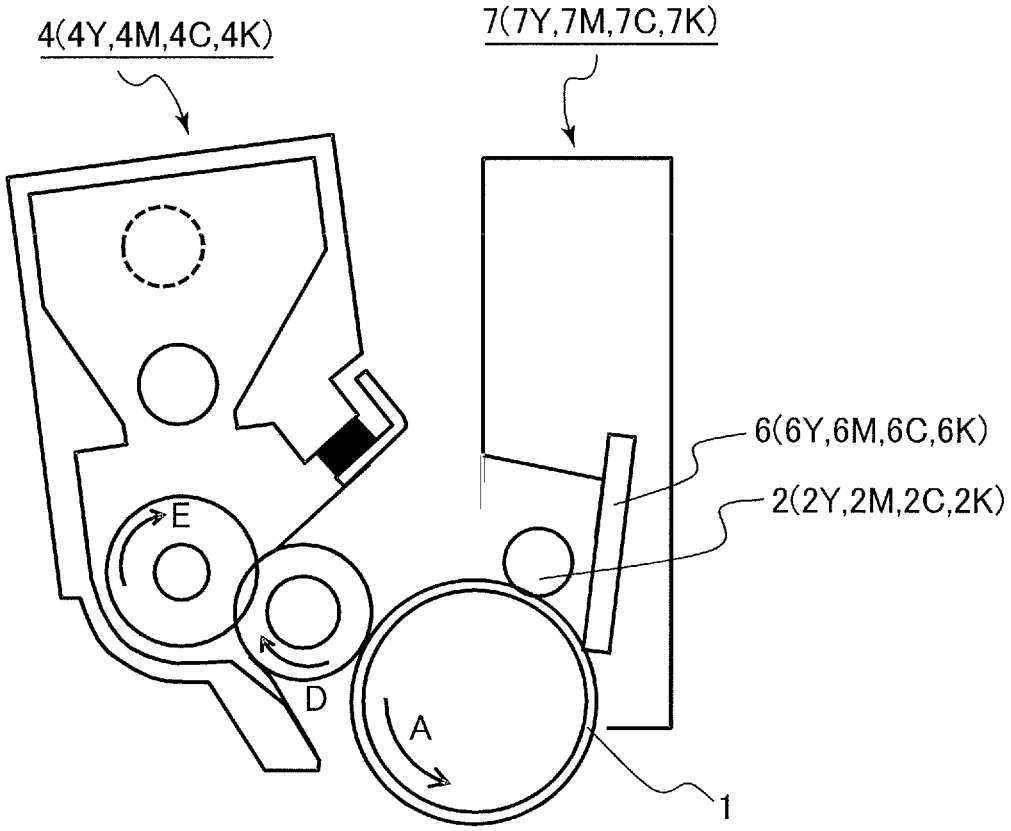
FIG. 2 illustrates a configuration of a process cartridge attached to the full-color laser printer.

The image forming portion 100B includes process cartridges 7 (7Y, 7M, 7C and 7K) forming, respectively, four color toner images of yellow, magenta, cyan and black. It is that the process cartridge 7 includes a photosensitive drum 1 (1Y, 1M, 1C and 1K), i.e., an image carrier, rotationally driven in a direction of an arrow A (counterclockwise) by a driving source not shown as shown in FIG. 2. The process cartridge 7 also includes a developing unit 4 (4Y, 4M, 4C and 4K) developing an electrostatic latent image formed on the photosensitive drum 1 as a toner image by adhering toner, and an electrifying roller 2 (2Y, 2M, 2C and 2K) homogeneously electrifying a surface of the photosensitive drum 1. Still further, the process cartridge 7 includes a cleaning member 6 (6Y, 6M, 6C and 6K).

The image forming portion 100B also includes a scanner unit 3 disposed right above the process cartridge 7 and forming the electrostatic latent image on the photosensitive drum 1 by irradiating a laser beam based on image information. The image forming portion 100B also includes an intermediate transfer belt unit 100C, a secondary transfer portion T2 and a fixing portion 10. The intermediate transfer belt unit 100C includes an endless intermediate transfer belt 5 and a primary transfer roller 8 (8Y, 8M, 8C and 8K) disposed within the intermediate transfer belt 5 so as to face to the photosensitive drum 1. The intermediate transfer belt 5 is stretched by a driving roller 53, a secondary transfer counter roller 52, and a driven roller 51 and is rotated in a direction of an arrow B while being in contact with all of the photosensitive drums 1.

Here, the primary transfer roller 8 forms the primary transfer portion T1 where the intermediate transfer belt 5 is in contact with the photosensitive drum 1 by pressing the intermediate transfer belt 5 toward the photosensitive drum 1 and applies a transfer bias to the intermediate transfer belt 5 by a bias applying portion not shown. Then, by applying the primary transfer bias to the intermediate transfer belt 5 by the primary transfer roller 8, the toner image of each color on the photosensitive drum 1 is transferred sequentially to the intermediate transfer belt 5 and a full-color image is formed on the intermediate transfer belt 5.

Still further, a secondary transfer roller 9 is disposed at a position, of an outer circumferential surface side of the intermediate transfer belt 5, facing to the secondary transfer counter roller 52 and forms the secondary transfer portion T2 by being in pressure contact with the secondary transfer counter roller 52 through an intermediary of the intermediate transfer belt 5. Then, the toner image on the intermediate transfer belt 5 is (secondarily) transferred to a sheet P by a bias of a polarity, inverse from a normal electrified polarity of toner, applied to the secondary transfer roller 9 from a secondary transfer bias power supply (high-voltage power supply), i.e., a secondary transfer bias applying portion not shown.

A sheet feeding apparatus 100D includes a stacking tray 28A provided in the printer body 100A, a sheet feeding portion 200 feeding a plurality of sheets P stored in the stacking tray 28A, and others. It is noted that in FIG. 1, the full-color laser printer 100 includes a CPU 300, i.e., a control portion, controlling an image forming operation of the image forming portion 100B, a sheet feeding operation of the sheet feeding apparatus 100D, and others.

Next, the image forming operation of the full-color laser printer 100 constructed as described above will be described. In response to an image signal inputted to the scanner unit 3 from an image reader not shown or a host device such as a personal computer connected to the printer body 100A, a laser beam corresponding to the image signal is irradiated on the photosensitive drum 1. At this time, because the surface of the photosensitive drum 1 has been electrified homogeneously with predetermined polarity and potential in advance, an electrostatic latent image is formed on the surface of the photosensitive drum 1 by the irradiation of the laser beam from the scanner unit 3. This electrostatic latent image is then developed by the developing unit 4 and is visualized.

For instance, a yellow electrostatic latent image is formed on the photosensitive drum 1Y by irradiating a laser beam corresponding to an image signal of yellow component color from the scanner unit 3 to the photosensitive drum 1Y. Then, this yellow electrostatic latent image is developed by yellow toner supplied from the developing unit 4Y to visualize as a yellow toner image. Then, as the photosensitive drum 1Y rotates, the toner image arrives at the primary transfer portion T1 where the photosensitive drum 1Y is in contact with the intermediate transfer belt 5. Then, the yellow toner image on the photosensitive drum 1Y is transferred to the intermediate transfer belt 5 at the primary transfer portion T1 by the primary transfer bias applied to the primary transfer roller 8Y.

Next, in response to a move of a region of the intermediate transfer belt 5 carrying the yellow toner image, a magenta toner image formed up to then on the photosensitive drum 1M by the same method as describe above is transferred to the intermediate transfer belt 5 on the yellow toner image. In the same manner, as the intermediate transfer belt 5 moves, cyan and black toner images are superimposed and transferred to the yellow and magenta toner images. Thereby, a full-color toner image is formed on the intermediate transfer belt 5.

In parallel with the toner image forming operation, the sheet P stored in the stacking tray 28A is delivered by the sheet feeding portion 200, is then separated one by one by a separating portion described later and is conveyed to the secondary transfer portion T2. In the secondary transfer portion T2, the full-color toner image on the intermediate transfer belt 5 is secondarily transferred to the sheet P conveyed thereto by the positive bias applied to the secondary transfer roller 9. It is noted that toner left on the intermediate transfer belt 5 after the secondary transfer of the toner image is removed by a belt cleaner 11. Next, the sheet P on which the toner image has been transferred is conveyed to a fixing portion 10 to be heated and pressed so that the full-color toner image is fixed to the sheet P as a permanent image. After that, the sheet P is discharged out of the printer body 100A.

Figure 3:
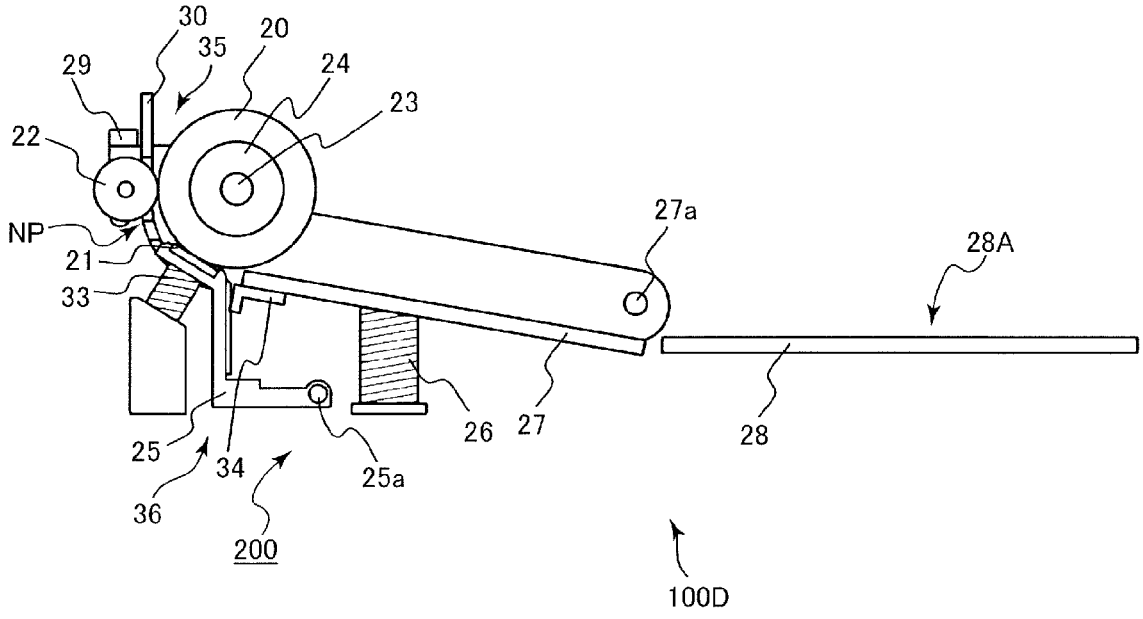
FIG. 3 is side view illustrating a configuration of the sheet feeding apparatus.

Next, the sheet feeding apparatus 100D of the present embodiment will be described in detail. The sheet feeding apparatus 100D includes the stacking tray 28A and the sheet feeding portion 200. As shown in FIG. 3, the sheet feeding portion 200 includes a pickup roller 20, i.e., a rotating body formed of rubber that comes into contact with and feeds an uppermost sheet among sheets stacked in the stacking tray 28A, i.e., a sheet stacking portion. The sheet feeding portion 200 also includes a separating member 21, i.e., a contact member, in contact with the pickup roller 20 and to separate the fed sheet one by one. The sheet feeding portion 200 further includes a driven roller 22, i.e., a driven rotating body or a contact member, disposed at downstream in a sheet feeding direction of the separating member 21 and in contact with the pickup roller 20. The driven roller 22, i.e., the driven rotating body, is formed of POM and is pressed to the pickup roller 20 by a spring not shown in the present embodiment.

The pickup roller 20 is linked with a driving shaft 23 driven by a motor 303 shown in FIG. 6 and described later through an intermediary of a torque limiter 24, i.e., a torque control portion. The driving shaft 23 rotates the pickup roller 20 by transmitting a driving force of the motor 303 to the pickup roller 20 until when a load in the sheet feeding direction of a predetermined (more than certain) torque is applied to the pickup roller 20 by an action of the pickup roller 20. The driving shaft 23 also rotates idly by not transmitting the driving force of the motor 303 in a case when the load in the sheet feeding direction of the predetermined (more than certain) torque has been applied to the pickup roller 20. That is, in a case when the more than the predetermined load is applied to the pickup roller 20 in a direction of interfering the feed of the sheet P, the driving shaft 23 rotates idly by the action of the torque limiter 24 and the pickup roller 20 stops to rotate.

The separating member 21 is formed of a material having a high friction coefficient and is attached to a support member 25 turnable in a vertical direction centering a shaft 25*a*. Here, the support member (holding portion) 25 holding the separating member 21 is biased upward by a compression spring 33, and the separating member 21 is in pressure contact detachably with the pickup roller 20 by the compression spring 33 through the intermediary of the support member 25. A separating portion 35 separating the sheet one by one is constructed by the separating member 21 in pressure contact with the pickup roller 20.

The stacking tray 28A includes a sheet stacking member 28 and a turning member (lift portion) 27 disposed at downstream in the sheet feeding direction of the sheet stacking member 28, i.e., the pickup roller 20 side, and composing a downstream portion in the sheet feeding direction of the stacking tray 28A. The turning member 27 is supported by the sheet stacking member 28 turnably in the vertical direction at a fulcrum of a shaft 27*a* and is biased upward by a compression spring 26. Then, a front end part of an uppermost sheet among the sheets stacked in the stacking tray 28A is pressed against the pickup roller 20 by the upward turn of the turning member 27 and the sheet is fed as the pickup roller 20 rotates in this state. That is, the stacking tray 28A has the liftable turning member 27 including at least the downstream portion in the sheet feeding direction.

Here, an operation of the turning member 27 is controlled by a press-down cam 305 attached to the driving shaft 23, shown in FIG. 6 and described later. The turning member 27 turns in the vertical direction and the sheet on the turning member 27 abuts against or separates from the pickup roller 20 when the press-down cam 305 rotates in synchronism with a sheet feeding timing.

Provided at a center under surface side of a front end part of the turning member 27 is a press-down member 34 composing a pressing portion that presses the support member 25 and presses down the separating member 21. Then, the separating member 21 turned downward is turned downward further as shown in FIG. 7B as described later by pressing the separating member 21 by the press-down member 34 through the intermediary of the support member 25.

It is noted that a separating member moving mechanism 36 moving the separating member 21 is composed of the press-down member 34 and the support member 25. Then, the separating member moving mechanism 36 moves the separating member 21 to a position in contact with the pickup roller 20 when the shutter member 29 is moved to a projecting position (a first position) described later. The separating member moving mechanism 36 also moves the separating member 21 to a position separated (a second position) from the pickup roller 20 when the shutter member 29 is moved to a set-back position described later.

It is noted that in FIG. 3, the sheet feeding portion 200 includes a conveyance guide 30 curved upward to guide the sheet and the shutter member 29 capable of stopping the sheet fed along the conveyance guide 30. The shutter member 29 is turnable centering on a shaft 29D shown in FIG. 4 and turnably supported by a frame not shown. Abutment portions 29A and 29B for temporarily stopping the sheet being fed by retractably projecting into a sheet conveying path R at one end (an end opposed to the shaft 29D) of the shutter member 29.

Figure 4:
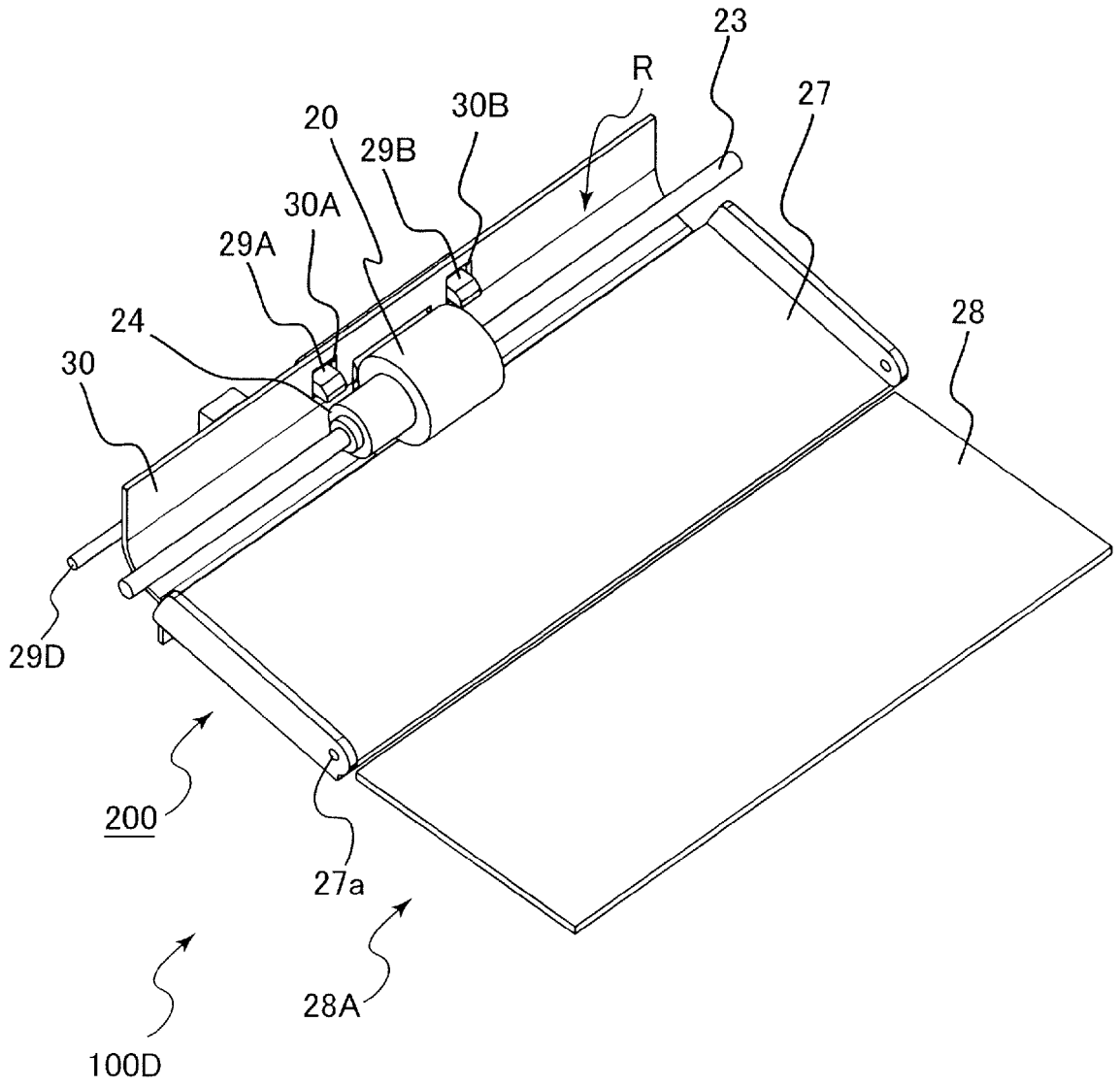
FIG. 4 is a perspective view illustrating the configuration of the sheet feeding apparatus.

Then, as shown in FIG. 4, the conveyance guide 30 is provided with opening portions 30A and 30B formed to project the abutment portions 29A and 29B into the sheet conveying path. Thereby, when the shutter member 29 is turned in feeding the sheet, the abutment portions 29A and 29B project through the opening portions 30A and 30B of the conveyance guide 30 into the sheet conveying path R and stop the sheet passing through the sheet conveying path R.

It is noted that the opening portions 30A and 30B are formed in vicinity at downstream in the sheet feeding direction of a nip portion NP of the pickup roller 20 and the driven roller 22. In other words, in the present embodiment, the abutment portions 29A and 29B of the shutter member 29 are disposed so as to abut against the front end of the sheet in the very vicinity in the sheet feeding direction of the nip portion NP of the pickup roller 20 and the driven roller 22 and in the vicinity of both sides in an axial direction of the pickup roller 20 of the nip portion NP as shown in FIG. 3. That is, the driven roller 22 is disposed between the separating member 21 and the shutter member 29 along the sheet conveying path R. Still further, the shutter member 29 is disposed at a position closer than a length in the sheet feeding direction of the sheet fed along the sheet conveying path from the pickup roller 20. That is, the shutter member 29 is disposed at the position separated from the pickup roller 20 by a distance shorter than the length in the sheet feeding direction of the sheet fed along the sheet conveying path.

This arrangement makes it possible to narrow a distance between the shutter member 29 and the nip portion NP of the pickup roller 20 and the driven roller 22, to enhance the rigidity of the front end part of the sheet and to make the front end part of the sheet hardly buckling in a case when the sheet is stopped by the shutter member 29. Still further, because a skew of the sheet can be corrected in the vicinity of the pickup roller 20, it is possible to shorten a distance to the secondary transfer portion T2 and to downsize the printer body 100A.

Figure 5A:
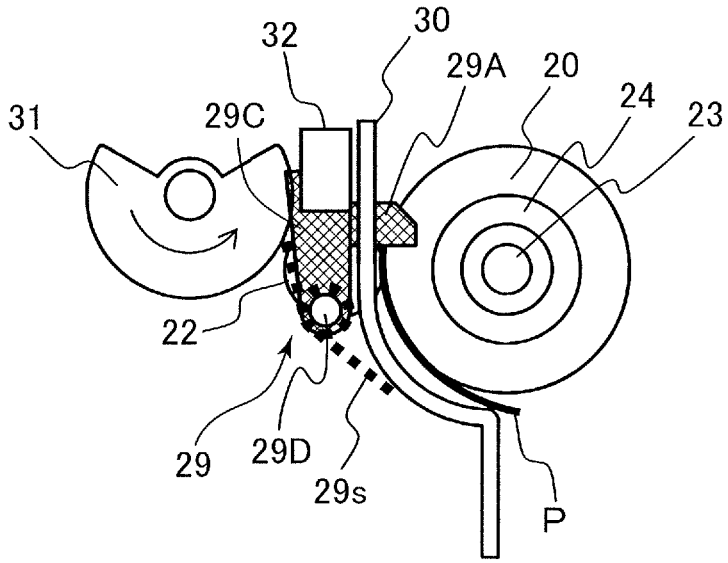
FIG. 5A illustrates an operation of a stopper cam in projecting a shutter provided in the sheet feeding apparatus.
Figure 5B:
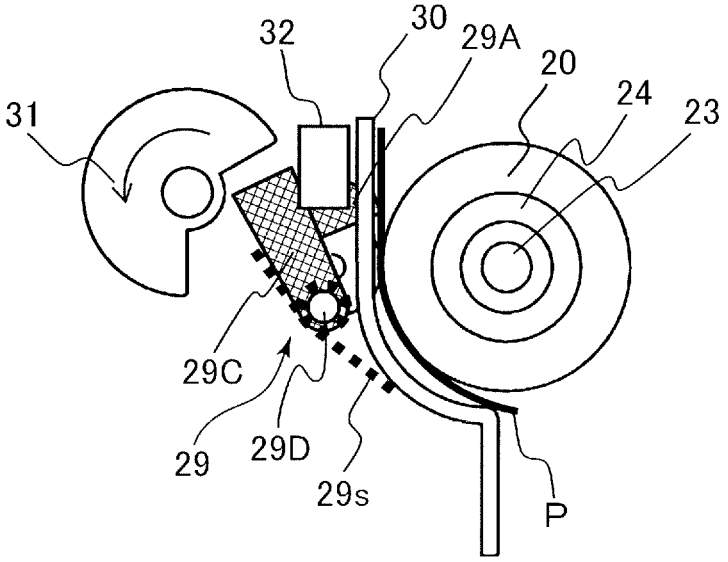
FIG. 5B illustrates an operation of the stopper cam in setting back the shutter provided in the sheet feeding apparatus.

The project and retraction of the shutter member 29 is performed by a stopper cam (lock mechanism) 31, i.e., a moving portion, shown in FIGS. 5A and 5B. FIG. 5A shows a state in which the stopper cam 31 restricts (locks) the shutter member 29 so that the shutter member 29 is not opened, i.e., so that the abutment portions 29A and 29B project into the sheet conveying path R. Here, the shutter member 29 is not released and the sheet P is stopped even if the sheet P arrives at the shutter member 29 because the stopper cam 31 has become a stopper of the shutter member 29 when the shutter member 29 is located at the projecting position. That is, the operation of the shutter member 29 is restricted by the stopper cam 31 and the shutter member 29 is kept closed during when the operation of the shutter member 29 is restricted by the stopper cam 31. That is, the abutment portions 29A and 29B project into the sheet conveying path.

FIG. 5B shows a state in which the restriction of the stopper cam 31 is released, the shutter member 29 is pushed up by the sheet P passing therethrough, and the abutment portions 29A and 29B set back from the sheet conveying path R, i.e., the shutter member 29 is moved to the set-back position and is opened. It is noted that in the present embodiment, while the shutter member 29 is biased in the direction of projecting into the sheet conveying path by a torsion coil spring (bias member) 29*s*, a bias force of the torsion coil spring 29*s* is set at a strength that permits the passing sheet P to push up the shutter member 29. Thereby, the restriction of the stopper cam 31 is released and if the front end of the sheet P abuts against the shutter member 29, the sheet P is fed while setting back the shutter member 29 from the sheet conveying path. That is, the sheet feeding portion 200 includes the torsion coil spring 29*s* biasing the shutter member 29 toward the projecting position and the stopper cam 31 capable of locking the shutter member 29 located at the projecting position. Then, the bias force of the torsion coil spring 29*s* is set at the strength by which the shutter member 29 moves to the set-back position by being pressed by the downstream end part of the sheet fed by the pickup roller 20.

As shown in FIGS. 5A and 5B, the shutter member 29 includes a sensor flag portion 29C. The sheet feeding portion 200 also includes a transmission type photo sensor (detecting portion) 32 and when the shutter member 29 rotates, the sensor flag portion 29C moves between a detection light projecting portion and a detection light receiving portion provided in the photo sensor 32. It is noted that in a state in which the shutter member 29 is closed as shown in FIG. 5A, the sensor flag portion 29C is located between the light projecting and receiving portions of the photo sensor 32 and cuts off the detection light of the photo sensor 32 (the photo sensor 32 is OFF). Still further, in a state in which the shutter member 29 is opened and opens the sheet conveying path as shown in FIG. 5B, the sensor flag portion 29C also exits from the space between the light projecting and receiving portions of the photo sensor 32 (the photo sensor 32 is ON).

Then, the CPU 300 detects that the sheet P has passed through while pushing up the shutter member 29 by a signal from the photo sensor 32 based on a change of a light receiving amount of the detection light cut off by the sensor flag portion 29C when the sheet P passes. Thus, the shutter member 29 also functions as a sensor flag detecting that the sheet P has passed in the present embodiment.

Figure 6:
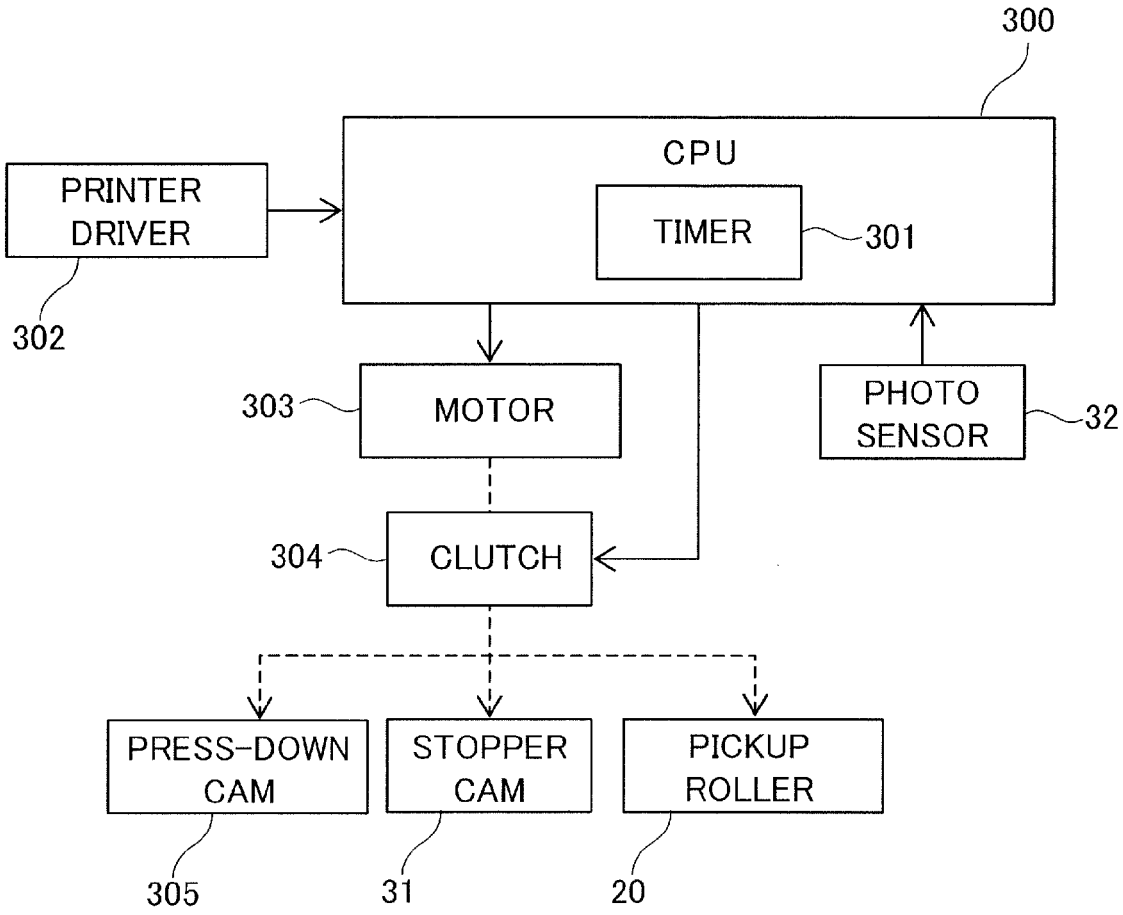
FIG. 6 is a control block diagram of the full-color laser printer.

FIG. 6 is a control block diagram of the full-color laser printer 100 of the present embodiment. As shown in FIG. 6, a timer 301 is mounted in the CPU 300. The CPU 300 is connected with a printer driver 302 and can read image information and a number of printed sheets from the printer driver 302. The CPU 300 is also connected with a motor 303, i.e., a driving source, driving the pickup roller 20, the press-down cam 305 and the stopper cam 31 and a clutch 304 selectively transmitting the driving force of the motor 303 to the pickup roller 20 and others. The CPU 300 is also connected with the photo sensor 32. That is, beside the pickup roller 20, the turning member 27 and the stopper cam 31 are operated by the driving source.

Next, a sheet feeding operation of the sheet feeding apparatus 100D will be described. FIG. 7B shows an initial state of the sheet feeding apparatus 100D before feeding a sheet. At this time, the turning member 27 is dropped and the separating member 21 is separated from the pickup roller 20. In response to a start of the image forming operation, the CPU 300 connects the clutch 304 at such a timing that the sheet P arrives at the secondary transfer portion T2 when the toner image transferred on the intermediate transfer belt 5 arrives at the secondary transfer portion T2 based on an image writing starting signal of the image forming portion 100B.

Thereby, the driving force of the motor 303 is transmitted to the driving shaft 23 driving the pickup roller 20, to the press-down cam 305 controlling the move of the turning member 27, and to the stopper cam 31 controlling the move of the shutter member 29. Along with that, the pickup roller 20 starts to rotate and the turning member 27 starts to rise as the press-down cam 305 rotates. Then, when the turning member 27 starts to rise, the press-down member 34 attached to the turning member 27 rises at first.

Figure 7A:
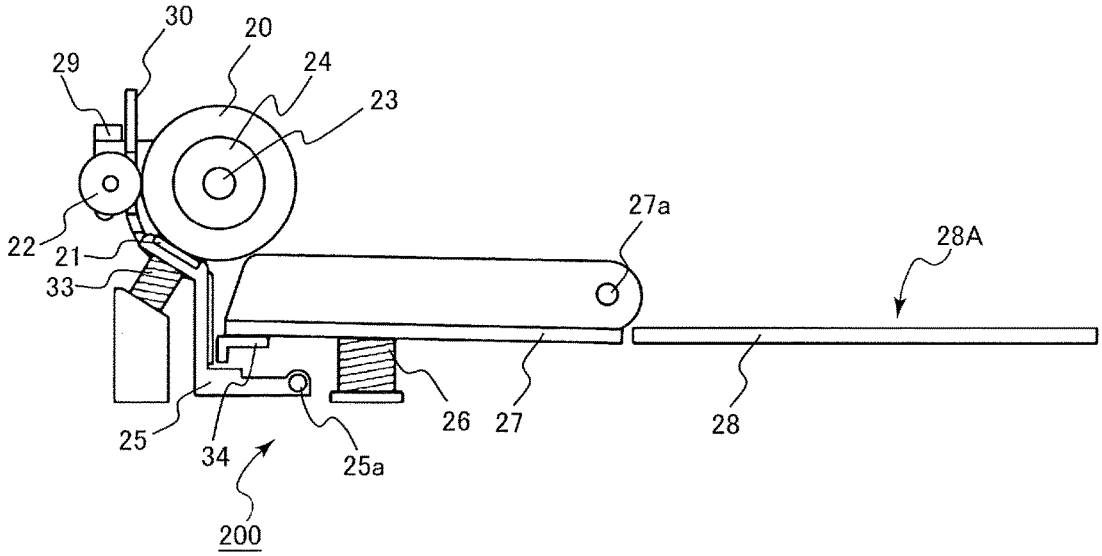
FIG. 7A illustrates a state in which a separating member of the sheet feeding apparatus is in contact with a pickup roller.
Figure 7B:
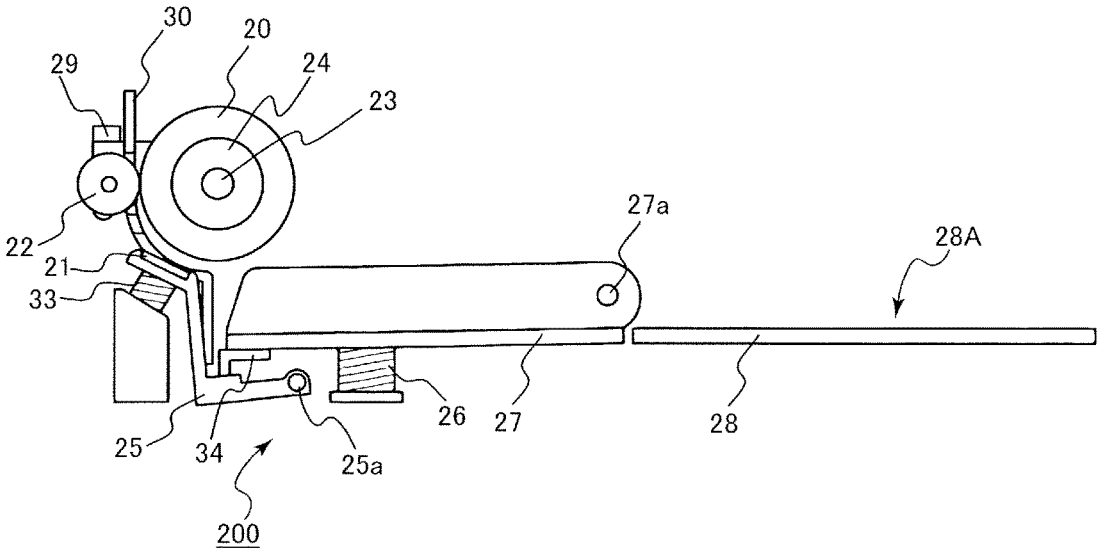
FIG. 7B illustrates a state in which the separating member of the sheet feeding apparatus is separated from the pickup roller.
Figure 8:
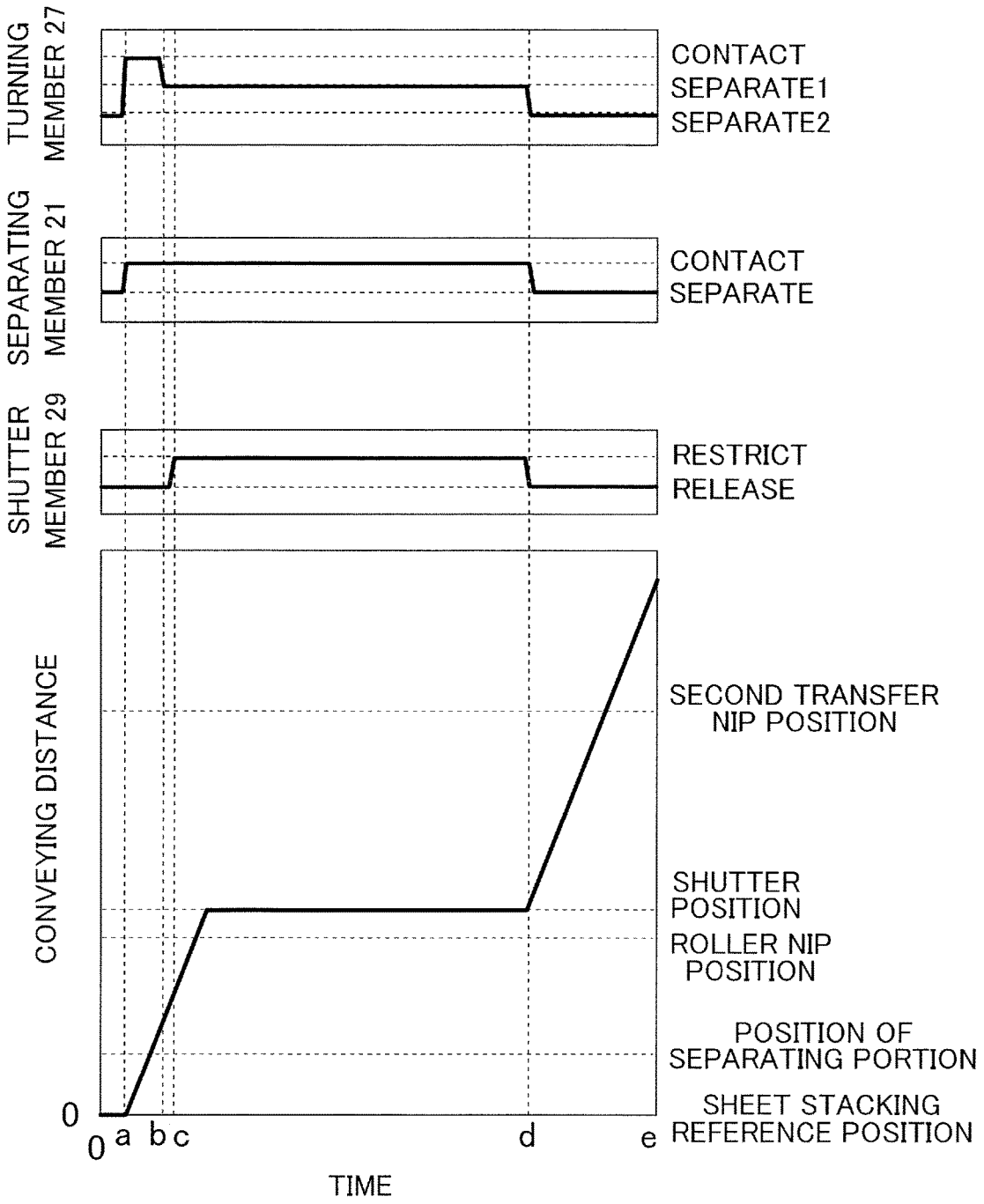
FIG. 8 is a timing chart illustrating a sheet feeding operation of the sheet feeding apparatus.

Thereby, the support member 25 which has been pressed down until then by resisting against the compression spring 33 rises and the separating member 21 comes into contact with the pickup roller 20 as shown in FIG. 7A. After that, the turning member 27 rises until when the sheet P comes into contact with the pickup roller 20 and the sheet P is then picked up by the pickup roller 20. That is, the sheet feeding apparatus 100D is configured such that the shutter member 29 is moved to the set-back position and the sheet P is fed to the image forming portion 100B in synchronism with the image forming timing of the image forming portion 100B. It is noted that FIG. 8 is a timing chart at this time.

By the way, if a feed resistance becomes higher than a set value of idling torque of the torque limiter 24 in feeding the sheet P, the driving shaft 23 rotates idly by a load torque caused by the feed resistance and the sheet P cannot be fed by the pickup roller 20. A condition in which the sheet P is fed by the pickup roller 20 can be expressed as follows considering a case when only one sheet P is stacked on the turning member 27 and a case when a plurality of sheets P is stacked on the turning member 27:

$$\mu b > \mu a \quad \text{eq. 1}$$

$$\mu b > \mu pp \quad \text{eq. 2}$$

$$T/r > \mu b N1 + \mu p N2 \quad \text{eq. 3}$$

where, r is a radius of the pickup roller 20, μa is a coefficient of friction between the sheet P and the turning member 27, μpp is a coefficient of friction between sheets of the plurality of sheets P, and N1 is a vertical drag of the turning member 27 to the pickup roller 20. Still further, μb is a coefficient of friction between the sheet P and the pickup roller 20, μp is a coefficient of friction between the pickup roller 20 and the separating member 21, N2 is a vertical drag of the separating member 21 to the pickup roller 20, and T is an idling starting torque of the torque limiter 24.

The one sheet or the plurality sheets fed as described above arrive at the separating portion 35, i.e., the nip portion NP, between the pickup roller 20 and the separating member 21 and are separated frictionally one by one by the pickup roller 20 and the separating member 21. Then, only a separated uppermost sheet is conveyed to a next step. Here, in the case when the plurality of sheets P is fed to the separating portion 35, a condition for separating the uppermost sheet can be expressed as follows:

$$\mu c N2 > \mu pp N2 \quad \text{eq. 4}$$

where μc is a coefficient of friction between the sheet P and the separating member 21.

Still further, a condition by which the pickup roller 20 can feed the separated sheet P can be expressed as follows:

$$T/r > \mu a N1 + \mu c N2 \quad \text{eq. 5}$$

$$T/r > \mu pp N1 + \mu c N2 \quad \text{eq. 6}$$

Here, when the uppermost sheet passes through the separating portion 35, the turning member 27 is pressed down by the press-down cam 305 in order to prevent a succeeding sheet from being unnecessarily fed and conveyed and to remove a sheet feed resistance otherwise generated by the press of the turning member 27. Then, the turning member 27 pressed down as described above drops so as to separate from the pickup roller 20 as shown in FIG. 7A at a point b in FIG. 8.

Meanwhile, in feeding the sheet P, the stopper cam 31 rotates and arrives at a position where the stopper cam 31, i.e., the stopper, can control the shutter member 29 at a point c in FIG. 8 so that the shutter member 29 does not open before the front end of the sheet P arrives at the shutter member 29. Thereby, the sheet P is stopped by the abutment portions 29A and 29B because the shutter member 29 cannot be opened by being controlled by the stopper cam 31 even if the sheet P abuts against the abutment portions 29A and 29B. Here, if a load greater than the idling starting torque T of the torque limiter 24 is applied to the pickup roller 20 by the stopped sheet P in a direction of interfering the feed of the sheet, the driving shaft 23 rotates idly by the torque limiter 24 and the pickup roller 20 is stopped.

Next, a balance of forces applied to the sheet P in a state in which the sheet P is in contact with the abutment portions 29A and 29B of the shutter member 29 without buckling can be expressed as follows:

$$Fs = T/r - \mu c N2 \quad \text{eq. 7}$$

where, Fs is a load applied by a resilience of the sheet P in a direction opposite from the feed direction of the pickup roller 20 when the sheet P abuts against the shutter member 29.

Actually, however, the sheet P receives friction forces with the turning member 27, the separating member 21, and the conveyance guide 30 when the sheet P is fed by the pickup roller 20 and receives the feed resistance such as that receiving from the sheet conveying path R when the sheet P is fed through the curved sheet conveying path. These feed resistances applied to the sheet P also change depending on position and attitude of the sheet P and on states of the respective members in contact with or separated from the sheet P.

Accordingly, the equation 7 is a lowest condition set in all kinds of conditions, and actually it is necessary to set T by considering other feed resistances such as a friction force with the conveyance guide 30 and a resistance receiving from the curved sheet conveying path R corresponding to each state. Therefore, if the other feed resistances, i.e., K, are added to the condition of the equation 7, the load Fs can be expressed as follows:

$$Fs = T/r - (\mu c N2 + K) \quad \text{eq. 8}$$

Then, it is necessary to meet the following equation in terms of the idling starting torque T to prevent the sheet P from buckling between the abutment portions 29A and 29B of the shutter member 29 and the nip portion NP of the pickup roller 20 and the separating member 21:

$$T/r - (\mu c N2 + K) < Fsb \quad \text{eq. 9}$$

where, Fsb is a load when the resilience of the sheet P is weak and the sheet P buckles.

It is also necessary to meet the following equation in terms of the idling starting torque T to prevent the sheet P from slipping against the pickup roller 20 during when the sheet P is stopped by the shutter member 29:

$$\mu b(N2 + N3) > T/r \quad \text{eq. 10}$$

where, N3 is a vertical drag of the driven roller 22 to the pickup roller 20.

Then, T, i.e., the idling starting torque of the torque limiter 24, is set such that the abovementioned relationships are met in the present embodiment. This arrangement makes it possible to rotate the driving shaft 23 idly by the load applied by the resilience of the sheet P to the pickup roller 20 without buckling between the separating portion 35 and the shutter member 29 during when the sheet P is stopped by the shutter member 29.

That is, the pickup roller 20 is deactivated by the action of the torque limiter 24 during when the shutter member 29 stops the sheet P by setting the idling starting torque T of the torque limiter 24 as described above. It is then possible to correct a skew of the sheet without generating a loop of the sheet by deactivating the pickup roller 20 during when the shutter member 29 stops the sheet P.

After that, the restriction (control) of the shutter member 29 is released in response to the turn of the stopper cam 31 at the timing set in advance to meet with the timing when the toner image is conveyed by the intermediate transfer belt 5 to the secondary transfer portion T2. Thereby, the load which has been applied by the sheet P to the pickup roller 20 is released, the driving shaft 23 transmits the driving force again to the pickup roller 20 and the sheet P which has been restricted by the shutter member 29 is conveyed again.

It is noted that the feed of the sheet P may vary due to a shift of a feed starting position caused by a slip during the feed, a shift of a stacked position, or a double feed caused by a preceding sheet. However, in the present embodiment, the shutter member 29 is controlled by the stopper cam 31 so as not to open until when a time during which the sheet P can arrive at the shutter member 29 elapses even in all those conceivable situations. This arrangement makes it possible to steadily match the front end of the sheet P with the toner image on the intermediate transfer belt 5 in the secondary transfer portion T2.

Here, in the present embodiment, the turning member 27 is pressed down further concurrently with the release of the shutter member 29 as shown in FIG. 7B at a point d in FIG. 8 to reduce the feed resistance in feeding sheet P again along with the opening of the shutter member 29. It is then possible to press down the support member 25 and to separate the separating member 21 from the pickup roller 20 by moving the turning member 27 to a position of a separate 2 (shown in FIG. 7B) which is lower than a position of a separate 1 (shown in FIG. 7A) shown in FIG. 8 as described above.

It is noted that a condition by which the shutter member 29 being pressed by the sheet P in abutment is opened can be expressed by setting Fsp as follows:

$$T/r > Fsp + K \qquad \text{eq. 11}$$

where, Fsp is a force of the torsion coil spring 29*s* biasing the shutter member 29 so as to project into the sheet conveying path. Then, it is possible to reduce the feed drag force and to improve feeding accuracy of the sheet P by setting Fsp as described above.

It is possible to stop the sheet P by the shutter member 29 without forming a loop and then to convey the sheet P at the timing of coinciding with the toner image at the secondary transfer portion T2 by setting the various coefficients of friction, the idling torque of the torque limiter 24, and others as described above. That is, it is possible to feed the sheet stably without forming a loop by setting the various coefficients of friction, the idling torque of the torque limiter 24, and the feed drag force so as to meet all of the conditions of equations 1 through 11 described above.

It is noted that the press-down cam 305 and the stopper cam 31 that have started to rotate by the connection of the clutch 304 end to rotate once at a point of time after when the sheet P arrives at the secondary transfer portion T2 and return to the positions in starting the feed operation. Still further, the clutch 304 cuts off transmitting of the driving force from the motor 303 to the driving shaft 23, the press-down cam 305 and the stopper cam 31 at a point e in FIG. 8. The sheet P is conveyed after that by a conveying mechanism of the secondary transfer portion and thereafter.

Still further, because it is possible to detect that the sheet P has passed by opening/closing the shutter member 29 in the present embodiment, it is possible to detect that a delay or stay jam has occurred by a signal from the photo sensor 32 when a jam of the sheet P occurs.

Figure 9:
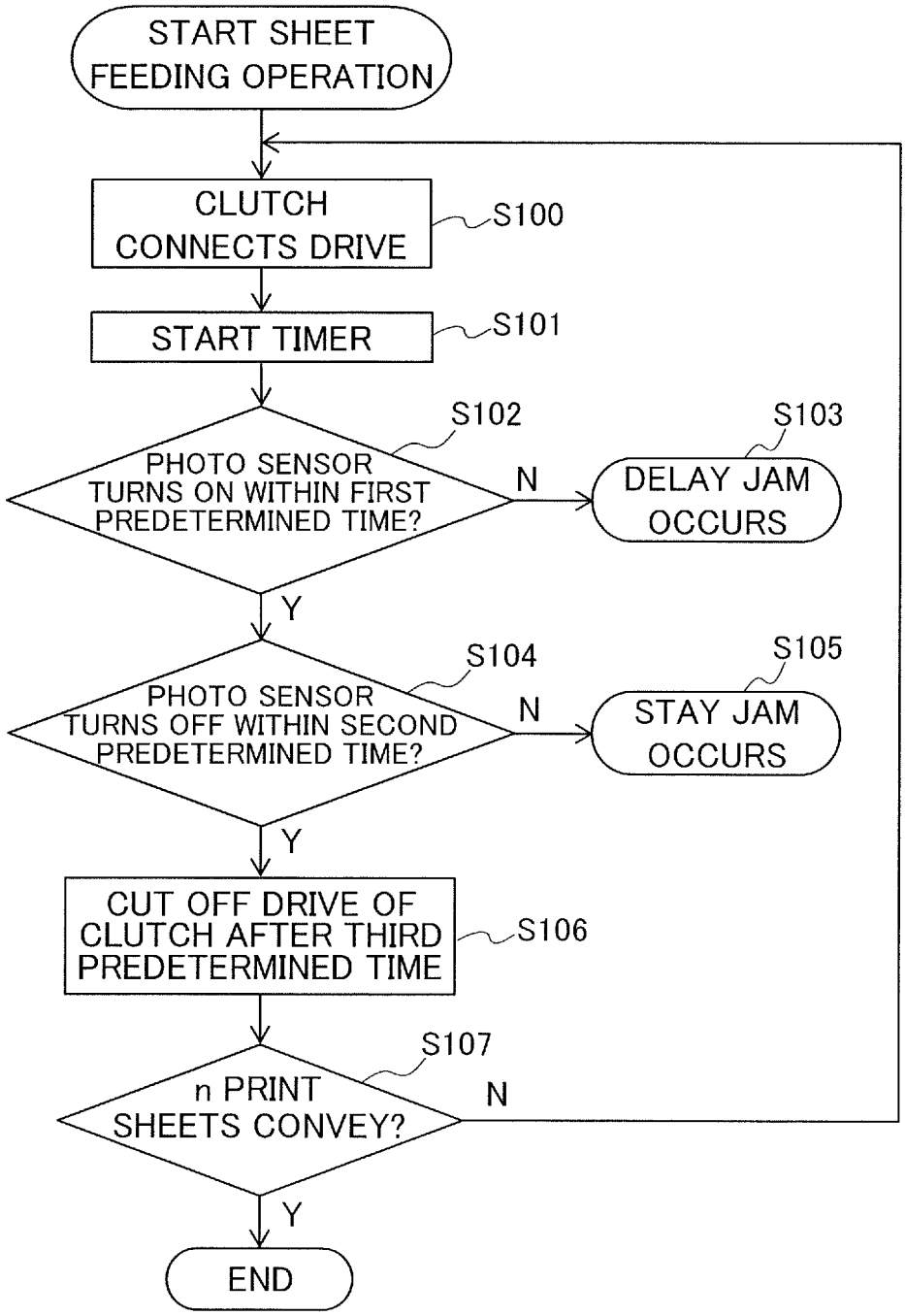
FIG. 9 is a flowchart illustrating the sheet feeding operation of the sheet feeding apparatus.

Next, the sheet feeding operation of the full-color laser printer 100 constructed as described above will be described with reference to a flowchart shown in FIG. 9. Before starting the image forming operation, the CPU 300 reads image information of an image to be printed and a required number of printed sheets n from the printer driver 302 at first. Next, the CPU 300 drives the motor 303 to start the sheet feeding operation and then connect the clutch 304. Thereby, the clutch 304 connects the drive of the motor 303 with the pickup roller 20, the stopper cam 31, and the press-down cam 305 in Step S100. When the drive is connected by the clutch 304, the pickup roller 20, the stopper cam 31 and the press-down cam 305 start to rotate.

Here, as the stopper cam 31 rotates, the abutment portions 29A and 29B of the shutter member 29 move to the closed position, i.e., project into the sheet conveying path, at the timing set in advance by the shape of the cam. Still further, as the press-down cam 305 rotates, the turning member 27 rises at the timing set in advance by the shape of the cam and the separating member 21 comes in contact with the pickup roller 20. It is noted that in response to the connection of the clutch 304, the CPU 300 starts the timer 301 in Step S101 to count an elapsed time from when the drive is connected by the clutch 304.

When the sheet P passes through while pushing up the shutter member 29 after that, the photo sensor 32 is turned ON. At this time, the CPU 300 compares a first predetermined time set in advance and required for the sheet P to pass through the shutter member 29 when the sheet P is normally fed with a counted time of the timer 301. That is, the CPU 300 judges whether or not the photo sensor 32 has turned ON within the first predetermined time in Step S102. Then, if it is judged that the photo sensor 32 has not turned ON within the first predetermined time, i.e., No in Step S102, the CPU 300 judges that the feed of the sheet P is delayed, i.e., that a delay jam has occurred, in Step S103.

In a case when the sheet P has normally passed through the shutter member 29, the photo sensor 32 turns OFF within a second predetermined time in which the photo sensor 32 is turned from ON to OFF in a case when the sheet P is normally fed. Then, when the photo sensor 32 is turned ON within the first predetermined time, i.e., Yes in Step S102, the CPU 300 compares next the second predetermined time with a counted time of the timer 301. That is, the CPU 300 detects whether or not the photo sensor 32 has turned OFF within the second predetermined time in Step S104.

If the photo sensor 32 has not turned OFF within the second predetermined time, i.e., No in Step S104, the CPU 300 judges that the feed of the sheet P is delayed, i.e., that a stay jam has occurred, in Step S105. Still further, if the photo sensor 32 has turned OFF within the second predetermined time, i.e., Yes in Step S104, the CPU 300 judges that the sheet P is being normally fed without causing delay or stay jam. Then, the CPU 300 release the clutch 304 after a third predetermined time to cut off the drive of the pickup roller 20 and others by the clutch 304 in Step S106.

Then, after driving the motor 303 for a fourth predetermined time, the CPU 300 judges whether or not the required number n of printed sheets has been conveyed in Step S107. Then, if the required number n of printed sheets has been conveyed, i.e., Yes in Step S107, the CPU 300 stops the motor 303. If the required number n of printed sheets has not been conveyed, i.e., No in Step S107, the CPU 300 repeats Steps 100 through 107 to repeat the feeding operation of the sheets P until reaching to the required number n of printed sheets.

As described above, according to the present embodiment, the sheet is stopped in the vicinity of the nip portion NP by projecting the shutter member 29 in the very vicinity downstream in the sheet feeding direction of the nip portion NP of the pickup roller 20 and the driven roller 22. Then, when the sheet is stopped by the shutter member 29 and a load in the sheet feeding direction of more than a certain magnitude is applied to the pickup roller 20, the sheet feeding portion is configured to prevent a loop from being formed by idly rotating the driving shaft 23 by the torque limiter 24.

Here, it becomes possible to feed the sheets stably by preventing the formation of the loop because it is possible to prevent a thin sheet whose rigidity is low from buckling during its feed or an increase of feeding load in feeding a thick sheet whose rigidity is high. Still further, because the sheet is fed toward the shutter member 29 by the pickup roller 20, i.e., because the pickup roller 20 functions also as a sheet conveying roller, it is possible to downsize the printer body 100A. Thus, because no loop is formed by idly rotating the driving shaft 23 by the torque limiter 24 when the sheet is stopped and the pickup roller 20 functions also as the sheet conveying roller, it is possible to stably feed the sheet and to downsize the printer body 100A.

Figure 10A:
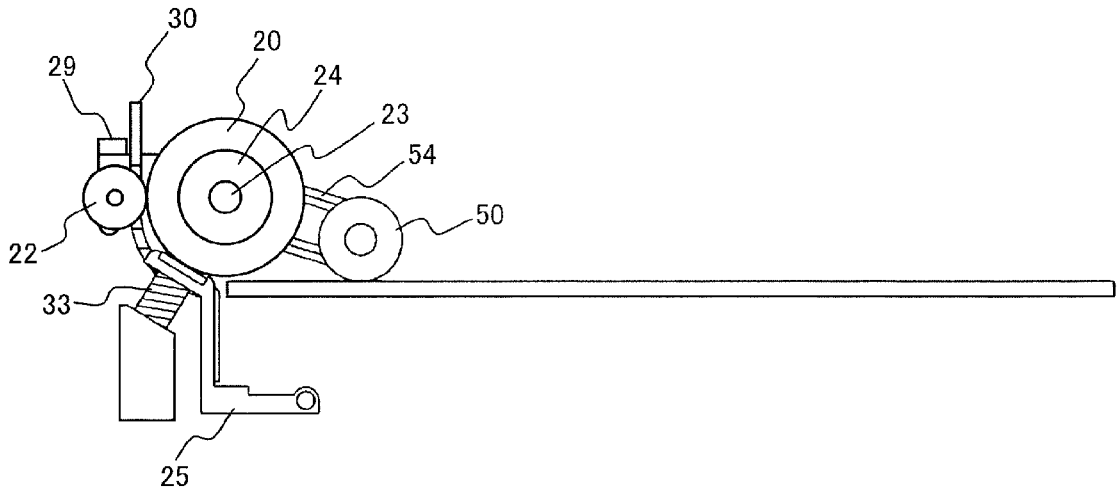
FIG. 10A is illustrates a modified example of the sheet feeding apparatus having a different configuration including two pickup rollers connected by a timing belt.
Figure 10B:
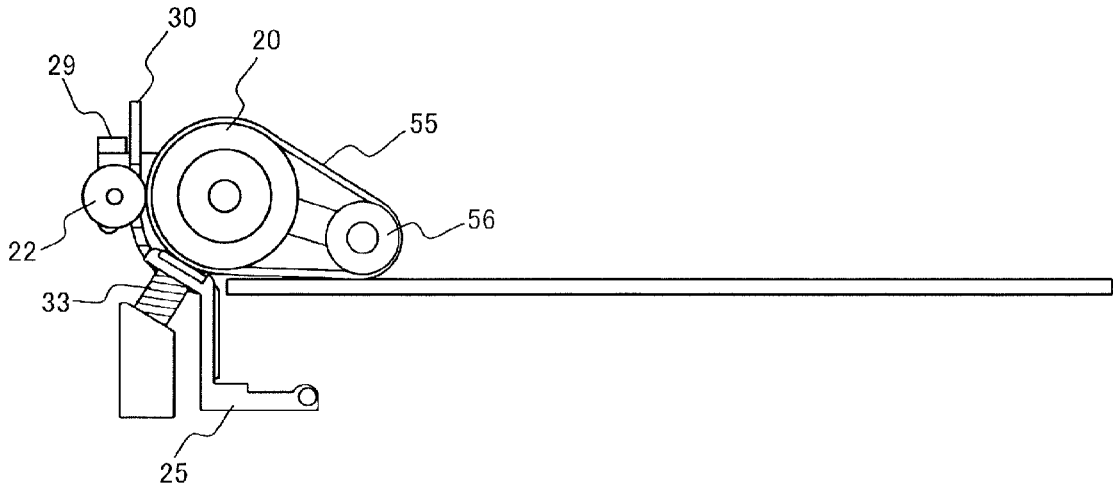
FIG. 10B illustrates a still other modified example of the sheet feeding apparatus using an endless belt instead of the pickup roller.

It is noted that the pickup roller 20 has been used as the sheet pickup mechanism in the present embodiment, it is also possible to adopt a pickup mechanism configured such that two rollers (rotating bodies) 20 and 50 are linked by a timing belt 54 as shown in FIG. 10A. Still further, as the sheet pickup mechanism, a mechanism of delivering a sheet by a rubber-made endless belt (rotating member) 55 wrapped around two rollers 20 and 56, instead of the rubber roller, as shown in FIG. 10B.

Figure 11:
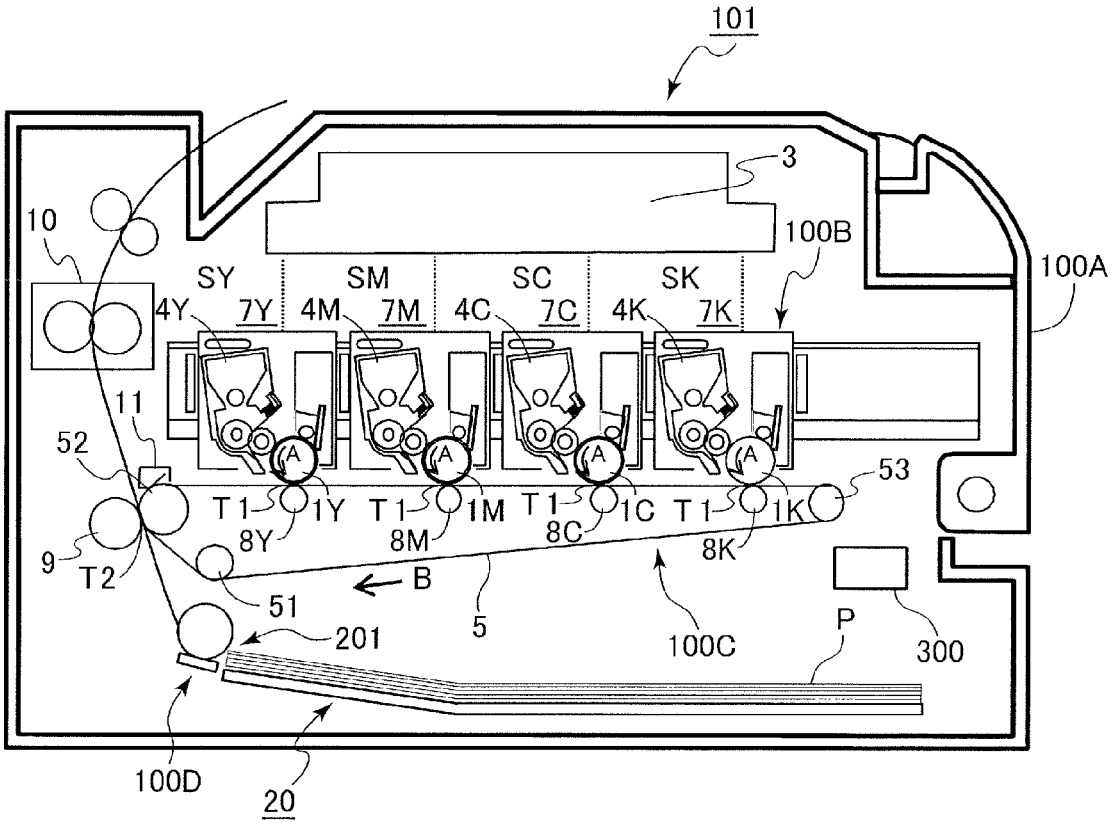
FIG. 11 is a schematic diagram of an entire full-color laser printer, i.e., an exemplary image forming apparatus, including a sheet feeding apparatus of a second embodiment of the present invention.

Next, a second embodiment of the present invention will be described. FIG. 11 is a schematic diagram of an entire full-color laser printer 101, i.e., an exemplary image forming apparatus, including a sheet feeding apparatus of the second embodiment. It is noted that in FIG. 11, the same reference numerals with those indicated in FIG. 1 denote the same or corresponding components.

Figure 12:
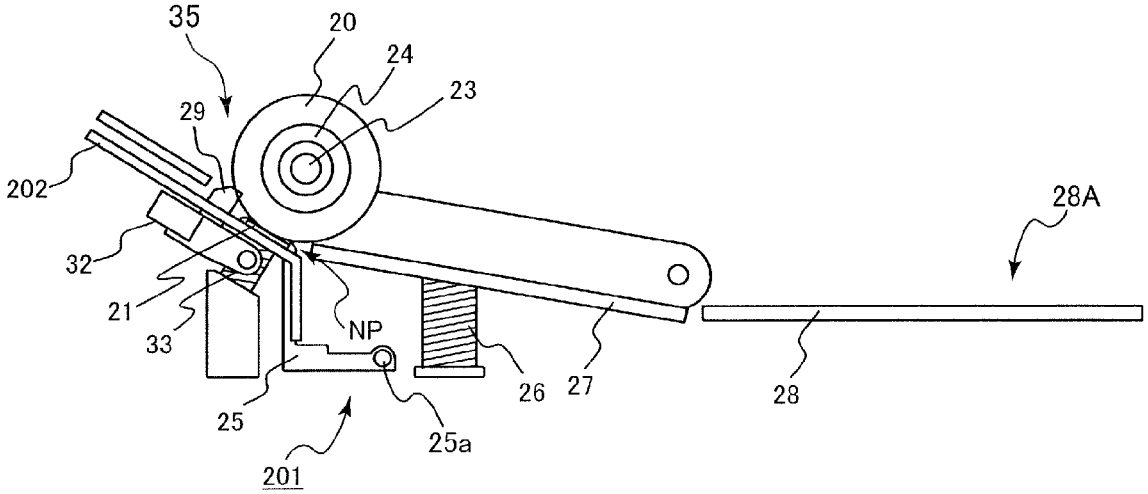
FIG. 12 illustrates a configuration of the sheet feeding apparatus provided in the full-color laser printer.

In FIG. 11, the full-color laser printer 101 includes a sheet feeding portion 201. As shown in FIG. 12, the sheet feeding portion 201 includes a pickup roller 20 and a shutter member 29 provided right after a nip portion NP of a pickup roller 20 and a separating member 21. It is noted that in FIG. 12, the sheet feeding portion 201 includes a linearly extending conveyance guide 202, and the conveyance guide 202 includes opening portions formed similarly to those shown in FIG. 4. Then, abutment portions 29A and 29B similar to those shown in FIG. 4 of the shutter member 29 retractably project into the sheet conveying path through the opening portions formed through the conveyance guide 202.

Similarly to the first embodiment, the pickup roller 20 is provided with a torque limiter 24 such that a driving shaft 23 idly rotates when a load of more than a certain magnitude is applied to the pickup roller 20 in a direction of interfering the feed of the sheet P also in the present embodiment. Thereby, during when the sheet P is stopped by the shutter member 29, the driving shaft 23 idly rotates by the load applied by resilience of the sheet P to the pickup roller 20 and the pickup roller 20 stops.

Here, it is necessary to meet the conditional expressions 1 through 7 described above in terms of the idling torque by which the torque limiter 24 starts idling. Still further, in the present embodiment, it is necessary to consider other feed resistances K which the sheet P receives during its feed such as a friction with the conveyance guide 202 similarly to the first embodiment even though the conveying path is not curved like that of the first embodiment. Accordingly, it is necessary to meet the expressions 8 and 9 also in the present embodiment.

Still further, in the present embodiment, a condition by which no slip occurs between the pickup roller 20 and the sheet P during when the sheet P abuts against the abutment portions 29A and 29B of the shutter member 29 can be expressed as follows:

$$\mu bN2>T/r \qquad \text{eq. 12}$$

Then, it is possible to prevent the sheet P from buckling between the separating portion 35 and the shutter member 29 during when the sheet P is stopped by the shutter member 29 by adequately setting the idling starting torque T of the torque limiter 24 also in the present embodiment. This arrangement also makes it possible to idly rotate the driving shaft 23 and to deactivate the pickup roller 20 by the load applied to the pickup roller 20 by the resilience of the sheet P.

As described above, according to the present embodiment, the sheet is stopped by projecting the shutter member 29 at the very vicinity downstream in the sheet feeding direction of the nip portion NP of the pickup roller 20 and the separating member 21. Then, the sheet feeding portion is configured to prevent a loop from being formed by idly rotating the driving shaft 23 by the torque limiter 24 when the sheet is stopped by the shutter member 29 and the load in the sheet feeding direction of more than a certain magnitude is applied to the pickup roller 20.

This arrangement makes it possible to feed the sheets stably by preventing buckling otherwise caused in feeding a thin sheet whose rigidity is low and an increase of feeding load in feeding a thick sheet whose rigidity is high similarly to the first embodiment. Still further, because the pickup roller 20 functions also as a sheet conveying roller, the apparatus can be downsized. It is noted that although not shown, the separating member moving mechanism 36 of the first embodiment may be provided also in the sheet feeding apparatus of the present embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076747, filed Apr. 3, 2014 which is hereby incorporated by reference herein in its entirety.

What is claimed is:

1. A sheet feeding apparatus comprising:

a sheet stacking portion on which a sheet is stacked;

a pick-up roller configured to contact with stacked sheets on the sheet stacking portion from above the sheet stacking portion and to feed an uppermost sheet from among the stacked sheets on the sheet stacking portion:

a driven rotating body contacting with the pick-up roller and driven by the pick-up roller;

a driving source configured to drive the pick-up roller;

a shutter member movable between a first position where the shutter member abuts against a downstream end portion in the sheet feeding direction of the sheet fed by the pick-up roller and stops the sheet and a second position where the sheet passes the shutter member, the shutter member disposed in a vicinity of a nip portion formed by the pick-up roller and the driven rotating body; and a torque limiter provided between the pick-up roller and the driving source, transmitting a driving force of the driving source to the pick-up roller in a state that a load of less than a predetermined torque is applied to the pick-up roller by the sheet, and not transmitting the driving force of the driving source to the pick-up roller in a state that the sheet is stopped by the shutter member and a load of more than the predetermined torque is applied to the pick-up roller by the sheet, wherein, when the shutter member is in the first position, the shutter member overlaps with the pick-up roller when viewed along a rotational axis of the pick-up roller.

2. The sheet feeding apparatus according to claim 1, further comprising a moving portion moving the shutter member between the first position and the second position.

3. The sheet feeding apparatus according to claim 1, further comprising:

a bias member biasing the shutter member toward the first position, a bias force of the bias member being set at such a magnitude by which the shutter member moves to the second position by being pressed by a downstream end portion of the sheet fed by the rotating body; and a lock mechanism capable of locking the shutter member located at the first position.

4. The sheet feeding apparatus according to claim 3 further comprising a detecting portion detecting whether the shutter member is located at the first position or the second position.

5. The sheet feeding apparatus according to claim 4, wherein the detecting portion detects passage of the sheet based on movement of the shutter member from the first position to the second position.

6. The sheet feeding apparatus according to claim 1, wherein the shutter member is disposed at a position so that the sheet abuts the shutter member while the sheet contacts the rotating body.

7. The sheet feeding apparatus according to claim 1, further comprising a separating member provided to be able to contact with and to separate from the rotating body and separating the sheet fed by the rotating body, the separating member provided upstream in the sheet feeding direction of the driven rotating body.

8. The sheet feeding apparatus according to claim 7 further comprising:

a moving portion moving the shutter member between the first position and the second position; and a separating member moving mechanism moving the separating member to a position where the separating member is in contact with the rotating body when the shutter member is moved to the first position by the moving portion and moving the separating member to a position where the separating member is separated from the rotating body when the shutter member is moved to the second position by the moving portion.

9. The sheet feeding apparatus according to claim 8, wherein the sheet stacking portion includes a lift portion; and wherein the separating member moving mechanism includes a turnable holding portion holding the separating member to be able to contact with and to separate from the rotating body and a pressure portion provided in the lift portion of the sheet stacking portion and pressing the holding portion when the lift portion drops to move the separating member in a direction of separating from the rotating body.

10. The sheet feeding apparatus according to claim 1 further comprising:

a bias member biasing the shutter member toward the first position, a bias force of the bias member being set at such a magnitude by which the shutter member moves to the second position by being pressed by a downstream end portion of the sheet fed by the rotating body; and a lock mechanism capable of locking the shutter member located at the first position; and wherein the sheet stacking portion includes a lift portion; and wherein the driving source operates the lock mechanism and the lift portion.

11. An image forming apparatus comprising:

an image forming portion forming an image; and a sheet feeding apparatus as set forth in claim 1 that feeds the sheet to the image forming portion.

12. The image forming apparatus according to claim 11, wherein the sheet feeding apparatus feeds the sheet to the image forming portion by moving the shutter member to the second position by synchronizing with an image forming timing of the image forming portion.

* * * * *